US011448994B2

(12) United States Patent
Kojima

(10) Patent No.: US 11,448,994 B2
(45) Date of Patent: Sep. 20, 2022

(54) IMAGE FORMING APPARATUS, IMAGE FORMING METHOD, AND NON-TRANSITORY RECORDING MEDIUM

(71) Applicant: TOSHIBA TEC KABUSHIKI KAISHA, Tokyo (JP)

(72) Inventor: Ryosuke Kojima, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 255 days.

(21) Appl. No.: 16/828,917

(22) Filed: Mar. 24, 2020

(65) Prior Publication Data

US 2021/0302893 A1 Sep. 30, 2021

(51) Int. Cl.

| | |
|---|---|
| ***G03G 15/00*** | (2006.01) |
| ***B65H 7/06*** | (2006.01) |
| ***B65H 43/04*** | (2006.01) |

(52) U.S. Cl.

CPC ..... *G03G 15/6567* (2013.01); *B65H 7/06* (2013.01); *B65H 43/04* (2013.01); *G03G 15/6594* (2013.01); *B65H 2511/11* (2013.01); *G03G 2215/00329* (2013.01)

(58) Field of Classification Search

CPC ..... B65H 2511/11; B65H 43/04; B65H 7/06; G03G 15/6594; G03G 15/6567; G03G 2215/00329

See application file for complete search history.

(56) References Cited

U.S. PATENT DOCUMENTS

| | | | | |
|---|---|---|---|---|
| 2015/0014915 | A1* | 1/2015 | Takahashi | B65H 85/00 271/186 |
| 2016/0182753 | A1* | 6/2016 | Takahashi | H04N 1/0057 358/1.12 |
| 2017/0253053 | A1* | 9/2017 | Shinohara | B41J 11/007 |
| 2018/0107146 | A1* | 4/2018 | Shinohara | G03G 15/6552 |
| 2019/0294086 | A1* | 9/2019 | Saito | G03G 15/5016 |

FOREIGN PATENT DOCUMENTS

JP 2012-071916 A 4/2012

* cited by examiner

*Primary Examiner* — David H Banh

(74) *Attorney, Agent, or Firm* — Foley & Lardner LLP

(57) ABSTRACT

An image forming apparatus includes a conveyor, an actuator, an image forming unit, a detection unit, and a controller. The conveyor transports a sheet having a length measured in a transport direction. The actuator drives the conveyor. The image forming unit forms an image on the sheet. The detection unit includes a first sheet detection sensor that outputs a detection signal indicating whether the sheet transported by the conveyor passes through a first predetermined detection position. The controller controls the actuator based on the length of the sheet in response to an indication that the detection unit is not operating normally.

18 Claims, 4 Drawing Sheets

IMAGE FORMING APPARATUS, IMAGE FORMING METHOD, AND NON-TRANSITORY RECORDING MEDIUM

FIELD

Embodiments described herein relate generally to an image forming apparatus, an image forming method, and a non-transitory recording medium.

BACKGROUND

When a sheet is enmeshed into a transfer belt in an image forming apparatus, there is concern of the sheet not being transported along an appropriate transport path. Accordingly, an image forming apparatus includes a sensor that detects whether a sheet is transported along an appropriate transport path in some cases. The image forming apparatus stops forming an image when the sensor does not normally operate. This is because a sheet invades into an inappropriate transport path and is likely to be moved up to a position at which a user may not extract the sheet. Through such control, it is possible to prevent the sheet from being moved up to the position at which the user may not extract the sheet. However, when the sensor does not operate normally, a sensor error occurs. Therefore, there is the problem that the user may not form an image.

DETAILED DESCRIPTION

An exemplary embodiment provides an image forming apparatus including a transport member or conveyor, a driving unit or actuator, an image forming unit or printing assembly, a detection unit or sheet detection sensor(s), and a control unit or controller. The transport member transports a sheet. The driving unit drives the transport member. The image forming unit forms an image on the sheet. The detection unit outputs a detection signal indicating whether the sheet transported by the transport member passes through a predetermined detection position. The control unit controls an operation of the driving unit according to a length in a transport direction of the sheet which is a target on which an image is formed by the image forming unit when the detection unit does not perform a normal operation.

Hereinafter, an image forming apparatus and an image forming method according to an embodiment will be described with reference to the drawings.

Figure 1:
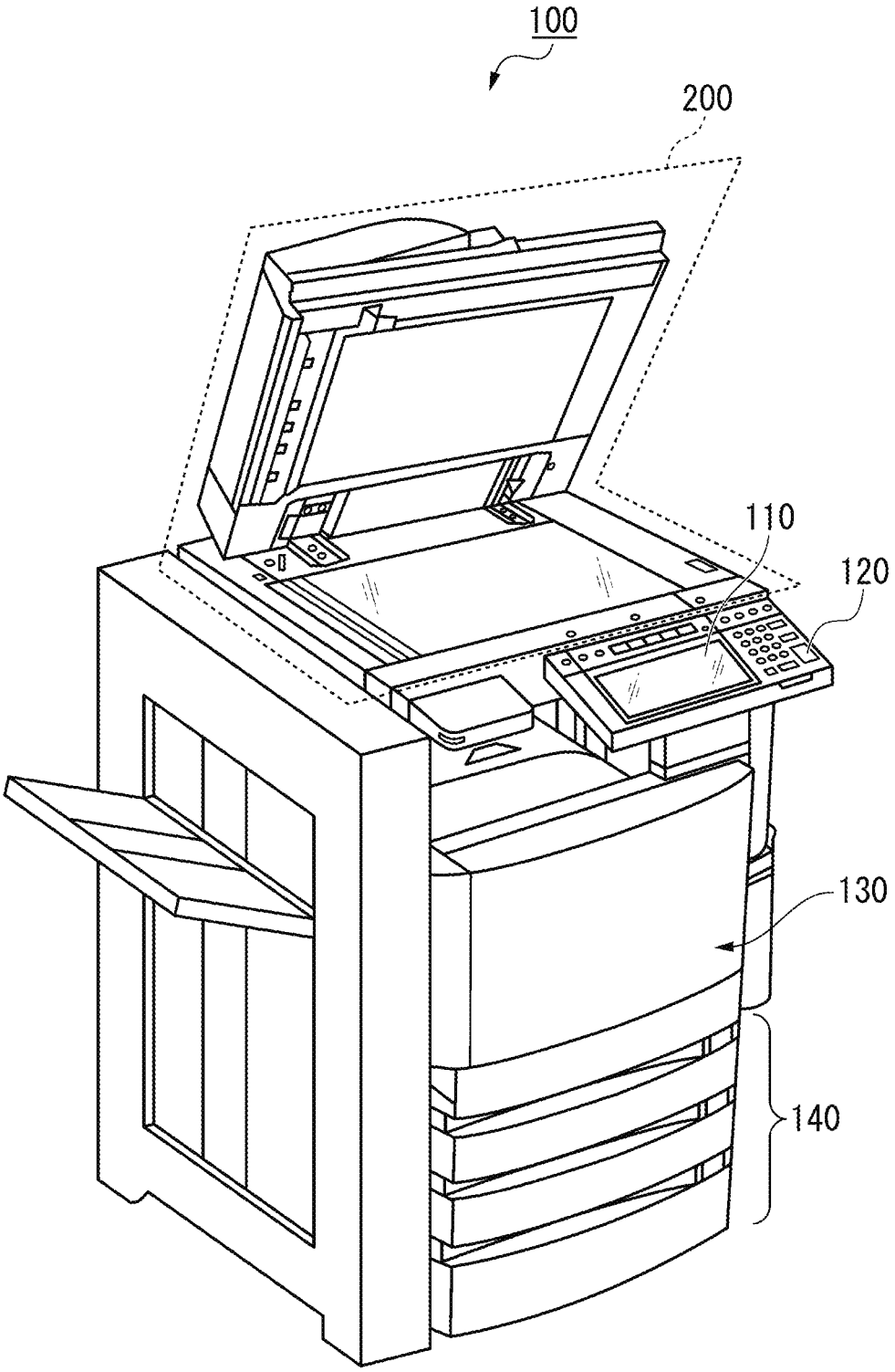
FIG. 1 is an external view illustrating an overall configuration of an image forming apparatus according to an embodiment.
Figure 2:
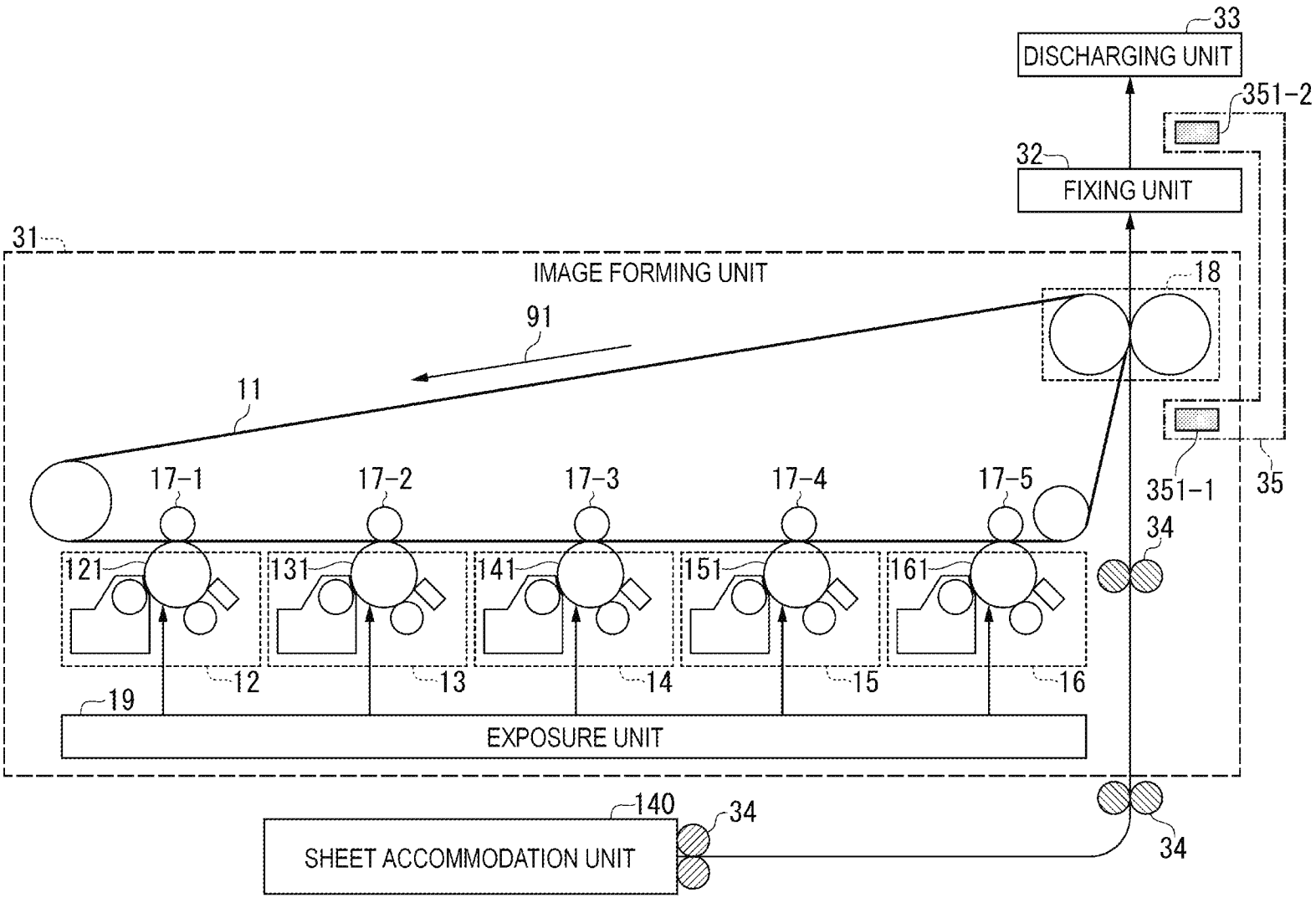
FIG. 2 is a diagram illustrating an example of a cross-sectional surface of the image forming apparatus of FIG. 1.

An example of a hardware configuration of the image forming apparatus 100 and an example of a transport path of a sheet according to an embodiment will be described with reference to FIGS. 1 and 2. FIG. 1 is a perspective view illustrating an overall configuration of the image forming apparatus 100 according to an embodiment. FIG. 2 is a diagram illustrating an example of a cross-sectional surface of the image forming apparatus 100.

The image forming apparatus 100 is, for example, a multi-function machine. The image forming apparatus 100 includes a display 110, a control panel 120, a printer unit 130, a sheet accommodation unit 140, and an image reading unit 200. The image forming apparatus 100 forms an image on a sheet using developer such as toner. The sheet is, for example, a paper or label sheet. The sheet may be any object as long as the image forming apparatus 100 can form an image on the surface of the sheet.

The display 110 is an image display device such as a liquid crystal display or an organic electro luminescence (EL) display. The display 110 displays various kinds of information regarding the image forming apparatus 100.

The control panel 120 includes a plurality of buttons. The control panel 120 receives an operation by a user. The control panel 120 outputs a signal according to the operation performed by the user to a control unit of the image forming apparatus 100. The display 110 and the control panel 120 may be configured as an integrated touch panel.

The printer unit 130 forms an image on a sheet based on image information generated by the image reading unit 200 or image information received via a communication path. For example, the printer unit 130 forms an image using developer such as toner. The sheet on which the image is formed may be a sheet accommodated in the sheet accommodation unit 140 or may be a sheet input by hand. The printer unit 130 includes an image forming unit 31, a fixing unit 32, a paper discharging unit 33, a transport member 34, and a detection unit 35.

The image forming unit 31 includes an intermediate transfer body 11, development units 12 to 16, a plurality of primary transfer rollers 17 (17-1 to 17-5), a secondary transfer unit 18, and an exposure unit 19. The development units 12 to 16 include photosensitive drums 121 to 161. For example, the image forming unit 31 operates as follows. The exposure unit 19 forms electrostatic latent images on the photosensitive drums 121 to 161 based on image information which is an image forming target. The development units 12 to 16 form visible images by attaching the developer to the electrostatic latent images. The primary transfer rollers 17-1 to 17-5 transfer the formed visible images to an image carrier (e.g., the intermediate transfer body 11). The intermediate transfer body 11 is an endless belt that is able to rotate in a direction indicated by an arrow 91. The intermediate transfer body 11 is rotated in the direction indicated by the arrow 91 to transport the transferred visible images up to the secondary transfer unit 18. The secondary transfer unit 18 transfers the visible images formed on the intermediate transfer body 11 to the sheet. Specifically, the secondary transfer unit includes a pair of rollers that press the sheet against the intermediate transfer body 11 to transfer the visible images to the sheet.

The fixing unit 32 fixes the visible images to the sheet by heating and pressurizing the visible images transferred to the sheet. The paper discharging unit 33 discharges the sheet on which the visible images are fixed by the fixing unit 32.

The transport members 34 (i.e., conveyors) transport the sheet. Each transport member 34 includes, for example, a pair of rotatable rollers. In other embodiments, the transport members 34 include one or more conveyor belts. The image forming apparatus 100 includes the plurality of transport members 34. The transport members 34 transport a sheet accommodated in the sheet accommodation unit 140 to the secondary transfer unit 18. The sheet transported to the secondary transfer unit 18 is transported to the fixing unit 32 by the transport members 34.

The detection unit 35 outputs a signal (hereinafter referred to as a "detection signal") indicating whether the sheet transported by the transport member 34 passes through a predetermined position (hereinafter referred to as a "detection position"). The detection unit 35 may include any type of device or unit that is able to output a detection signal indicating whether the sheet is present in a corresponding detection position. The number of detection positions may be single or plural. The detection unit 35 may include, for example, detection devices 351-1 to 351-2 (i.e., sheet detection sensors). According to an exemplary embodiment, each of the detection devices 351-1 to 351-2 emits (e.g., radiates) a laser toward the detection position, receives reflected light of the radiated laser, and outputs a signal according to the received reflected light as a detection signal (e.g., each detection device may be a break beam sensor). The signal according to the reflected light is, for example, a signal according to the strength (e.g., magnitude, intensity, etc.) of the reflected light. The strength of the reflected light may vary based on whether or not a sheet is present at the corresponding detection position. By way of example, the sheet may block the laser, resulting in a reduced strength of the reflected light. The detection position differs for each detection device. For example, in FIG. 2, a detection position of the detection device 351-1 is a position at which a sheet invades (e.g., is first introduced, enters, etc.) into the secondary transfer unit 18. In FIG. 2, a detection position of the detection device 351-2 is a position at which a sheet passes through the fixing unit 32.

The sheet accommodation unit 140 accommodates a sheet to be used for the printer unit 130 to form an image.

The image reading unit 200 reads reading target image information as brightness and darkness of light. The image reading unit 200 records the read image information. The recorded image information may be transmitted to another information processing device via a network. The recorded image information may be formed as an image on a sheet by the printer unit 130.

Here, an example of the transport path of a sheet will be described. The image forming apparatus 100 is an apparatus that is designed so that a sheet is transported along a predetermined transport path. However, in some cases, a sheet invades into an inappropriate transport path and the sheet is moved up to a position at which a user may not extract the sheet. In FIG. 2, the predetermined transport path is, for example, a path in which a sheet is transported to the fixing unit 32 after the sheet is transported to the secondary transfer unit 18. On the other hand, the inappropriate transport path is a path in which a sheet transported to the secondary transfer unit 18 is enmeshed into the intermediate transfer body 11 and is transported in the direction indicated by the arrow 91 by the intermediate transfer body 11. In this case, the position at which the user may not extract the sheet is, for example, a position at which the visible image is transferred to the intermediate transfer body 11 by the primary transfer roller 17-1.

Figure 3:
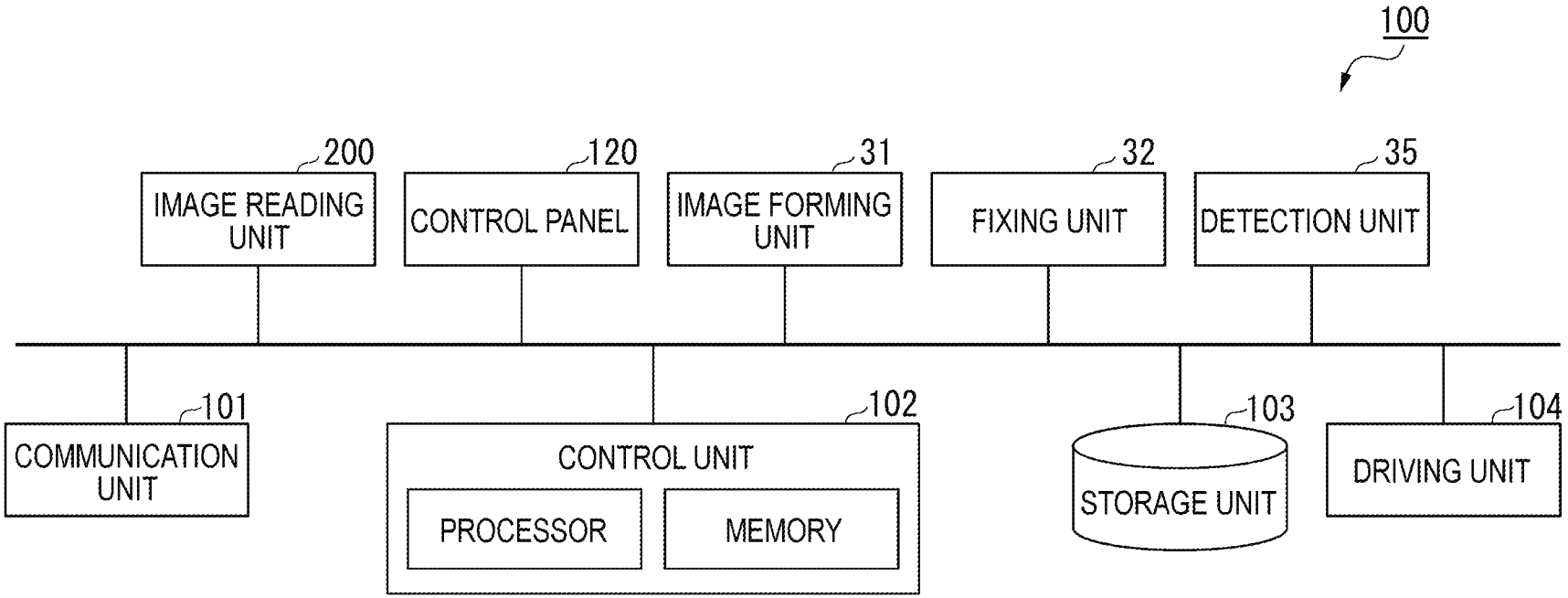
FIG. 3 is a diagram illustrating an example of a functional configuration of the image forming apparatus of FIG. 1.

FIG. 3 is a diagram illustrating an example of a functional configuration of the image forming apparatus 100. The image forming apparatus 100 includes the image reading unit 200, the control panel 120, the image forming unit 31, the fixing unit 32, the detection unit 35, a communication unit 101, a control unit 102, a storage unit 103, and a driving unit 104 connected via buses.

The communication unit 101 includes a communication interface that connects the image forming apparatus 100 to an external apparatus. The communication unit 101 communicates with the external apparatus through a wired or wireless connection and outputs the received information to the control unit 102. The communication unit 101 receives, for example, a printing job. The printing job may include image information and sheet size information. The sheet size information is information indicating a size of a forming target sheet on which an image indicated by the image information is formed.

The control unit 102 (i.e., a controller) is configured using a processor such as a CPU and a memory. The control unit 102 operates when the processor executes a program. The control unit 102 controls an operation of each functional unit included in the image forming apparatus 100. The control unit 102 controls, for example, an operation of the image forming unit 31. The control unit 102 controls, for example, an operation of the fixing unit 32. The control unit 102 controls, for example, an operation of the driving unit 104.

The control unit 102 determines whether the detection unit 35 is operating normally. For example, when one or more of the detection devices output a control signal indicating that a sheet does not pass through the detection position consecutively a predetermined number of times or more, the control unit 102 determines that the operation is not normal. Alternatively, when there is a detection device that constantly outputs a control signal indicating that a sheet is passing through the detection position while the image forming apparatus 100 is in a state in which no sheet should be passing through the detection position (e.g., the sheet has not yet been removed from the sheet accommodation unit 140, the detection device 351-2 indicates that a sheet is passing through its corresponding detection position prior to the detection device 351-1 indicating that the sheet is passing through its corresponding detection position), the control unit 102 may determine that the operation is not normal. When the detection unit 35 includes three or more detection devices, the control unit 102 may determine whether the operation of the detection unit 35 is normal as follows, for example. Specifically, when only one detection device outputs a detection signal indicating that the sheet does not pass through the detection position, the control unit 102 may determine that the operation is not normal. A determination result of normality or non-normality of the operation of the detection unit 35 by the control unit 102 is recorded in the storage unit 103 by the control unit 102.

The storage unit 103 is configured using a storage device such as a magnetic hard disk device or a semiconductor storage device. The storage unit 103 stores various kinds of information regarding the image forming apparatus 100. For example, the storage unit 103 stores a program to be executed by the processor of the control unit 102 in advance. The storage unit 103 stores information indicating a determination result of normality or abnormality of the operation of the detection unit 35 by the control unit 102 (hereinafter referred to as "error information").

The driving unit 104 (i.e., an actuator) drives the transport member 34. The driving unit 104 is, for example, a motor that operates under the control of the control unit 102.

When a sheet does not invade into the inappropriate transport path, printing can be performed without the use of the detection device 351-1. If the detection device 351-1 is in an abnormal state, the detection device 351-2 can detect that the sheet is not appropriately transported. However, even if transportation of the sheet is stopped at this time, the sheet may have already invaded a distance along the intermediate transfer belt 11, and thus the user may not be able to remove the sheet if the size of the sheet is small.

Accordingly, in one embodiment, when the control unit determines that the detection device 351-1 is abnormal, the detection device 351-1 is invalidated. When the size of a printing target sheet is equal to or greater than a predetermined size, printing can still be performed in this state, as the sheet is long enough to protrude from the intermediate transfer belt 11 sufficiently to be removed by a user.

Figure 4:
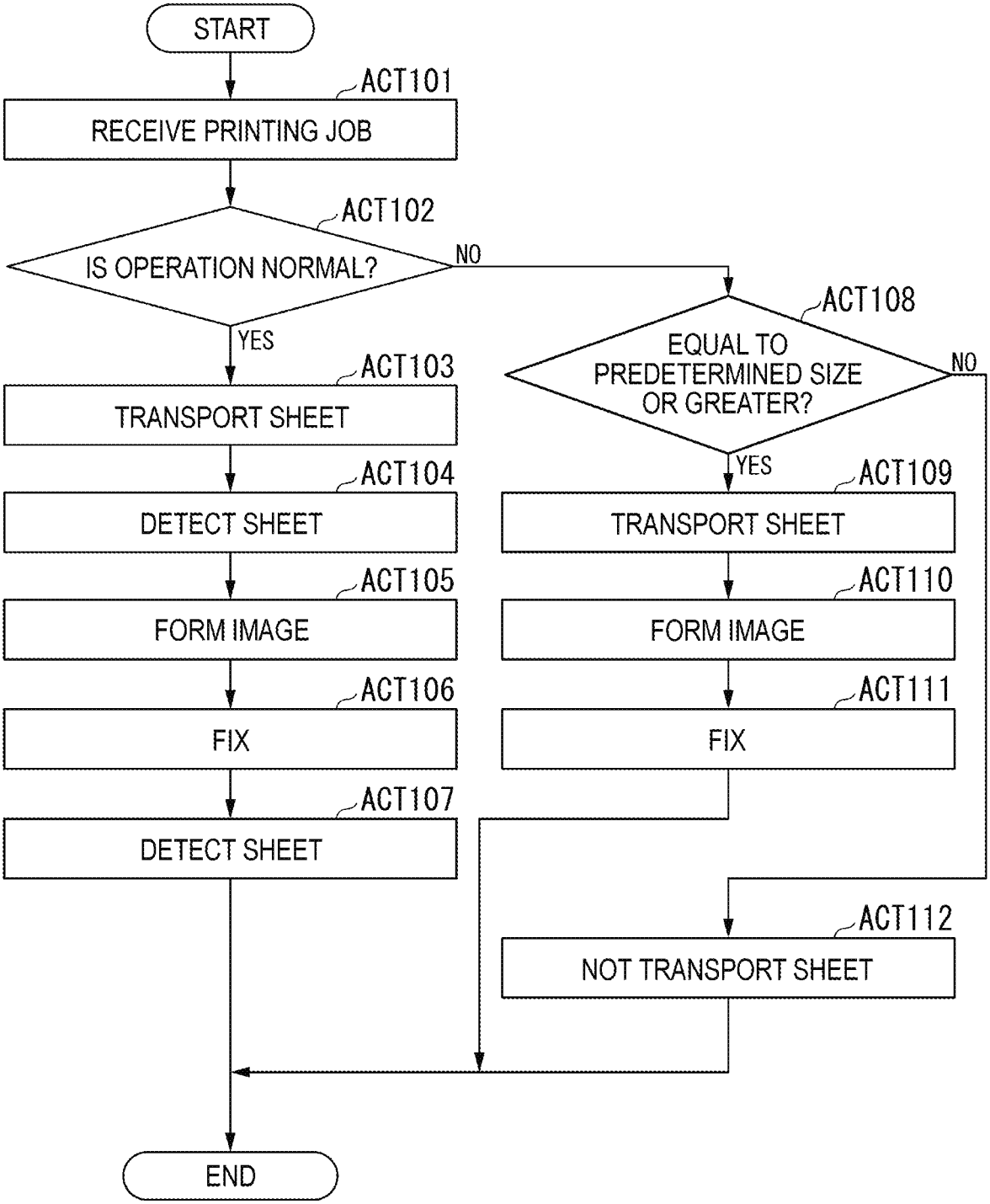
FIG. 4 is a flowchart illustrating an example of a flow of a process in the image forming apparatus of FIG. 1.

FIG. 4 is a flowchart illustrating an example of a flow of a process in the image forming apparatus 100. The communication unit 101 receives a printing job (ACT101). Referring to the error information, the control unit 102 determines whether an operation of the detection unit 35 is normal (ACT102). When the operation is normal (YES in ACT102), the control unit 102 controls the driving unit 104 such that a sheet is transported (ACT103). The detection unit 35 outputs a detection signal indicating that the sheet passes through a detection position of the detection device 351-1 (ACT104). Subsequently, the image forming unit 31 forms a visible image on the transported sheet (ACT105). Subsequently, the fixing unit 32 fixes the visible image on the sheet (ACT106). The detection unit 35 outputs a detection signal indicating that the sheet passes the detection position of the detection device 351-2 (ACT107).

Conversely, when the operation is not normal (NO in ACT102), the control unit 102 determines whether the size of the sheet indicated by the sheet size information is equal to or greater than a pre-decided predetermined size (ACT108). When the size of the sheet is equal to or greater than the predetermined size (YES in ACT108), the control unit 102 controls the driving unit 104 to transport the sheet (ACT109). Subsequently, the image forming unit 31 forms a visible image on the transported sheet (ACT110). Subsequently, the fixing unit 32 fixes the visible image on the sheet (ACT111). Conversely, when the size of the sheet is less than the predetermined size (NO in ACT108), the control unit 102 causes the driving unit 104 to stop transporting the sheet (ACT112) (e.g., to prevent further transportation of the sheet).

The predetermined size in ACT108 is, for example, a predetermined length in the transport direction of the sheet. The predetermined length in the transport direction of the sheet is, for example, a length of the sheet at which the user may not extract the sheet when the sheet has reached a predetermined position. The predetermined length in the transport direction of the sheet is, for example, longer than a distance from a position at which the user extracts the sheet (i.e., an extraction position) to a predetermined position at which the user may not extract the sheet. More specifically, the predetermined length is a length of a distance or more in which the sheet is transported along an inappropriate transport path until the control unit receives a signal indicating that the sheet is not correctly transported from the detection device 351-2, which is normally operating, and stops the transporting of the sheet. The position at which the user extracts the sheet is, for example, the position of the secondary transfer unit 18. In this case, since the sheet invading to the inappropriate transport path does not invade up to a predetermined position at which the sheet is not extractable, the user can extract the sheet. By way of example, the sheet may be incorrectly transported along the intermediate transfer body 11 instead of moving to the fixing unit 32. The sheet may travel along this inappropriate transfer path for a first period of time prior to the detection device 351-2 indicating that the sheet is being incorrectly transported and causing the control unit 102 to stop transportation of the sheet. This first period of time may correspond to a first distance that the sheet travels along the intermediate transfer body 11. This first distance may be the predetermined distance. If the length of the sheet is less than the predetermined distance, the end of the sheet may have moved beyond a location where the end of a sheet is accessible to the user. If the length of the sheet is greater than or equal to the predetermined length, the end of the sheet may be accessed by an operator (e.g., at the secondary transfer device 18) to remove the sheet.

The image forming apparatus 100 that has such a configuration includes the control unit 102 that controls an operation of the driving unit 104 according to the size of a sheet when the detection unit 35 does not normally operate. Therefore, even when a sensor is broken down, non-movement of the sheet up to the position at which the user may not extract the sheet and formation of an image can be compatible.

Modification Example

The detection unit 35 may not necessarily include the plurality of detection devices when the detection unit 35 can detect whether the sheet passes through a predetermined detection position. The detection unit 35 may include one detection device.

In the fixing unit 32 according to the embodiment, a method of fixing a visible image to a sheet by performing heating via a film-shaped member may be applied.

According to at least one of the above-described embodiments, the control unit 102 is included. Thus, even when the sensor is broken down, non-movement of the sheet up to the position at which the user may not extract the sheet and formation of an image can be compatible.

Some or all of the functions of the image forming apparatus 100 may be realized using hardware such as an application specific integrated circuit (ASIC), a programmable logic device (PLD), or a field programmable gate array (FPGA). A program may be recorded on a computer-readable recording medium. The computer-readable recording medium is, for example, a storage device such as a portable medium such as a flexible disc, a magneto-optic disc, a ROM, or a CD-ROM or a hard disk embedded in a computer system. The program may be transmitted via an electrical communication line.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a conveyor configured to transport a sheet, the sheet having a length measured in a transport direction;

an actuator configured to drive the conveyor;

an image forming unit configured to form an image on the sheet;

a detection unit including a first sheet detection sensor configured to output a first detection signal indicating whether the sheet transported by the conveyor passes through a first predetermined detection position; and a controller configured to:

determine whether the length of the sheet is greater than or equal to a predetermined length in response to an indication that the detection unit is not operating normally; and control the actuator to transport the sheet in response to a determination that the length of the sheet is greater than or equal to the predetermined length.

2. The image forming apparatus of claim 1, wherein, when the detection unit is operating normally, the detection unit outputs the first detection signal indicating that the sheet passes through the first predetermined detection position only when the sheet is transported along a predetermined transport path.

3. The image forming apparatus of claim 1, wherein the predetermined length is based on a distance that the sheet can travel along an inappropriate transport path beyond an extraction position before the controller stops transportation of the sheet.

4. The image forming apparatus of claim 3, wherein:

the image forming unit includes a photosensitive drum on which a visible image is formed by attaching developer on a surface of the photosensitive drum and an intermediate transfer body to which the visible image is transferred; and the extraction position is a position at which the visible image is transferred from the intermediate transfer body to the sheet.

5. An image forming apparatus comprising:

a conveyor configured to transport a sheet, the sheet having a length measured in a transport direction;

an actuator configured to drive the conveyor;

an image forming unit configured to form an image on the sheet;

a detection unit including a first sheet detection sensor configured to output a first detection signal indicating whether the sheet transported by the conveyor passes through a first predetermined detection position; and a controller configured to:

determine whether the length of the sheet is less than a predetermined length in response to an indication that the detection unit is not operating normally; and prevent the actuator from transporting the sheet in response to a determination that the length of the sheet is less than the predetermined length.

6. The image forming apparatus of claim 5, wherein the predetermined length is based on a distance that the sheet can travel along an inappropriate transport path beyond an extraction position before the controller stops transportation of the sheet.

7. The image forming apparatus of claim 6, wherein:

the image forming unit includes a photosensitive drum on which a visible image is formed by attaching developer on a surface of the photosensitive drum and an intermediate transfer body to which the visible image is transferred; and the extraction position is a position at which the visible image is transferred from the intermediate transfer body to the sheet.

8. The image forming apparatus of claim 1, wherein the detection unit further includes a second sheet detection sensor configured to output a second detection signal indicating whether the sheet is passing through a second predetermined detection position, the second predetermined detection position being farther in the transport direction than the first predetermined detection position.

9. The image forming apparatus of claim 8, wherein the controller is configured to determine that the detection unit is not operating normally in response to the second sheet detection sensor indicating that the sheet has passed through the second predetermined detection position prior to the first sheet detection sensor indicating that the sheet has passed through the first predetermined detection position.

10. The image forming apparatus of claim 1, wherein the controller is configured to determine that the detection unit is not operating normally in response to the first sheet detection sensor indicating that the sheet is passing through the first predetermined detection position when the image forming apparatus is in a state in which the sheet should not be passing through the first predetermined detection position.

11. The image forming apparatus of claim 1, wherein:

the detection unit further includes:

a second sheet detection sensor configured to output a second detection signal indicating whether the sheet is passing through a second predetermined detection position; and a third sheet detection sensor configured to output a third detection signal indicating whether the sheet is passing through a third predetermined detection position; and the controller is configured to determine that the detection unit is not operating normally in response to both (a) the second detection signal having indicated that the sheet has passed through the second predetermined detection position and (b) the third detection signal having indicated that the sheet has passed through the third predetermined detection position without the first detection signal having indicated that the sheet has passed through the first predetermined detection position.

12. The image forming apparatus of claim 1, wherein the image forming unit includes:

a photosensitive drum on which a visible image is formed by attaching developer on a surface of the photosensitive drum;

a belt onto which the visible image is transferred; and a secondary transfer unit including a pair of rollers that press the sheet against the belt to transfer the visible image from the belt to the sheet.

13. The image forming apparatus of claim 1, wherein the first sheet detection sensor is configured to:

emit light toward the first predetermined detection position;

receive a portion of the emitted light; and output the first detection signal, the first detection signal being based on a strength of the portion of the emitted light that is received by the first sheet detection sensor.

14. An image forming method to be performed by an image forming apparatus, the image forming method comprising:

driving, by an actuator, a conveyor such that the conveyor transports a sheet in a transport direction;

forming, by an image forming unit, an image on the sheet;

outputting, by a sheet detection sensor, a detection signal indicating whether the sheet transported by the conveyor is passing through a predetermined detection position;

determining whether the sheet detection sensor is operating normally;

determining whether a length of the sheet is less than a predetermined length in response to a determination that the sheet detection sensor is not operating normally; and stopping, by the actuator, movement of the conveyor in response to a determination that the length of the sheet is less than the predetermined length.

15. An image forming method to be performed by an image forming apparatus, the image forming method comprising:

driving, by an actuator, a conveyor such that the conveyor transports a sheet in a transport direction;

forming, by an image forming unit, an image on the sheet;

outputting, by a sheet detection sensor, a detection signal indicating whether the sheet transported by the conveyor is passing through a predetermined detection position;

determining whether the sheet detection sensor is operating normally;

determining whether a length of the sheet is greater than or equal to a predetermined length in response to a determination that the sheet detection sensor is not operating normally; and driving, by the actuator, the conveyor to continue transporting the sheet in response to a determination that the length of the sheet is greater than or equal to the predetermined length.

16. A non-transitory computer-readable medium having instructions stored thereon that, when executed by one or more processors, cause the one or more processors to implement operations comprising:

controlling an actuator to drive a conveyor that transports a sheet in a transport direction;

controlling an image forming unit to form an image on the sheet;

receiving a first signal from a first sensor of a detection unit indicating whether the sheet transported by the conveyor is passing through a first detection position;

determining whether the detection unit is operating properly;

comparing a length of the sheet in the transport direction to a predetermined length in response to a determination that the detection unit is not operating properly;

controlling the actuator to continue driving the conveyor in response to a determination that the length of the sheet is greater than the predetermined length; and controlling the actuator to stop driving the conveyor in response to a determination that the length of the sheet is less than the predetermined length.

17. The non-transitory computer-readable medium of claim 16, wherein the operations implemented by the one or more processors further comprise:

receiving a second signal from a second sensor indicating whether the sheet transported by the conveyor is passing through a second detection position, the second detection position being farther in the transport direction than the first detection position; and determining that the detection unit is not operating normally in response to the second sensor indicating that the sheet has passed through the second detection position prior to the first sensor indicating that the sheet has passed through the first detection position.

18. The non-transitory computer-readable medium of claim 16, wherein the operations implemented by the one or more processors further comprise:

receiving a second signal from a second sensor indicating whether the sheet transported by the conveyor is passing through a second detection position;

receiving a third signal from a third sensor indicating whether the sheet transported by the conveyor is passing through a third detection position; and determining that the detection unit is not operating normally in response to both (a) the second signal having indicated that the sheet has passed through the second detection position and (b) the third signal having indicated that the sheet has passed through the third detection position without the first signal having indicated that the sheet has passed through the first detection position.

* * * * *